US007686417B2

(12) United States Patent
Ota

(10) Patent No.: US 7,686,417 B2
(45) Date of Patent: Mar. 30, 2010

(54) MAINTENANCE LIQUID FOR INK JET RECORDING

(75) Inventor: Hitoshi Ota, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 479 days.

(21) Appl. No.: 11/589,681

(22) Filed: Oct. 30, 2006

(65) Prior Publication Data

US 2007/0132807 A1 Jun. 14, 2007

(30) Foreign Application Priority Data

Oct. 31, 2005 (JP) ..... P2005-315771
Dec. 19, 2005 (JP) ..... P2005-364469

(51) Int. Cl.
*B41J 2/165* (2006.01)

(52) U.S. Cl. ..... 347/28; 347/95; 347/100

(58) Field of Classification Search ..... 347/100, 347/95, 96, 101, 84, 85, 32, 31, 29, 30; 106/31.13, 106/31.6, 31.27; 523/160
See application file for complete search history.

(56) References Cited

U.S. PATENT DOCUMENTS

| | | | | |
|---|---|---|---|---|
| 5,825,380 | A * | 10/1998 | Ichizawa et al. | 347/28 |
| 5,917,512 | A * | 6/1999 | Weber et al. | 347/28 |
| 6,342,105 | B1 * | 1/2002 | Yano et al. | 347/28 |
| 2002/0008725 | A1 * | 1/2002 | Katsuragi et al. | 347/28 |
| 2005/0018023 | A1 * | 1/2005 | Momose et al. | 347/95 |

FOREIGN PATENT DOCUMENTS

| | | |
|---|---|---|
| JP | 4-261476 | 9/1992 |
| JP | 6-8437 | 2/1994 |
| JP | 8-30200 | 3/1996 |
| JP | 10-286977 | 10/1998 |
| JP | 11-263021 | 9/1999 |
| JP | 11-263022 | 9/1999 |
| JP | 2000-109733 | 4/2000 |
| JP | 2000-328093 | 11/2000 |
| JP | 2002-105500 | 4/2002 |
| JP | 2005-059326 | 3/2005 |
| JP | 2005-144708 | 6/2005 |
| JP | 2005-146224 | 6/2005 |

OTHER PUBLICATIONS

JPO computer English translation of JP 6-8437 dated Feb. 2, 1994.
JPO computer English translation of JP 8-30200 dated Mar. 27, 1996.
Patent Abstracts of Japan of JP 4-261476 dated Sep. 17, 1992 and English translation of Claim 1.
Patent Abstracts of Japan and computer English translation of JP 2000-328093 dated Nov. 28, 2000.
Patent Abstracts of Japan and computer English translation of JP 2000-109733 dated Apr. 18, 2000.
Patent Abstracts of Japan and computer English translation of JP 11-263021 dated Sep. 28, 1999.
Patent Abstracts of Japan and computer English translation of JP 11-263022 dated Sep. 28, 1999.
Patent Abstracts of Japan and computer English translation of JP 2002-105500 dated Apr. 10, 2002.
Patent Abstracts of Japan and computer English translation of JP 10-286977 dated Oct. 27, 1998.
Patent Abstracts of Japan and computer English translation of JP 2005-146224 dated Jun. 9, 2005.
Patent Abstracts of Japan and computer English translation of JP 2005-144708 dated Jun. 9, 2005.
Patent Abstracts of Japan and computer English translation of JP 2005-059326 dated Mar. 10, 2005.

* cited by examiner

*Primary Examiner*—Manish S Shah
(74) *Attorney, Agent, or Firm*—Ladas and Parry LLP

(57) ABSTRACT

This invention provides a maintenance liquid for ink jet recording containing water, a resin solvent, and a moisturizing agent.

20 Claims, No Drawings

MAINTENANCE LIQUID FOR INK JET RECORDING

The present application is based on Japanese Patent Application No. 2005-364469 filed on Dec. 19, 2005 and No. 2005-315771 filed on Oct. 31, 2005, and the contents thereof are incorporated herein by reference.

BACKGROUND

1. Technical Field

This invention relates to a maintenance liquid suitably used for printers for ink jet recording.

2. Related Art

Ink jet printers have recently been commercialized as noiseless, high speed, and high resolution non-impact printers. As a solvent for an ink used for ink jet recording, an aqueous ink using water and a water-soluble organic solvent is mainly used in view of odor, safety, and the like. Also, although water-soluble dyes have heretofore been used as colorants for the ink to be used for ink jet recording, a change from the water-soluble dyes to pigments have been made in view of printing quality improvement, image robustness, and the like, and use of the pigments is being expanded. Further, there is a tendency that a content of the pigment in the ink is increased.

Under the circumstances, since the ink is discharged from a nozzle having a microdiameter of about 20 to 50 μm in the ink jet recording method, an increase in viscosity of the ink and generation of deposits tend to occur in the vicinity of the nozzle front end due to volatilization of a low boiling point solvent, separation of a colorant, aggregation, and the like, and defects such as disturbed print and nozzle clogging are caused in some cases. A cap for nozzle drying prevention and a cleaning mechanism for cleaning with ink are ordinarily provided in the ink jet printers in order to prevent such defects, but the ink remaining in the mechanisms is dried to be thickened and solidified in some cases, leading to a failure in normal cleaning operation. These problems tend to occur when the apparatus is at rest for a long period of time. Although (1) a method of cleaning an ink flow passage by using a cleaning liquid when the defect occurs, (2) a method of substituting the ink with the maintenance liquid in advance of a rest when the apparatus is scheduled to be rest for a long time, and the like have been proposed as countermeasures against the problems, the effect depends greatly on performance of the cleaning liquid or the maintenance liquid used in each of the methods.

Examples of the cleaning liquid or the maintenance liquid include a maintenance liquid comprising polyvalent alcohol, monovalent alcohol, and water (JP-B-6-8437); a maintenance liquid comprising monovalent alcohol, a negative ion surfactant, and water (JP-B-8-30200); a cleaning liquid improved in antifungal/antibacterial effect by containing an isothiazolone compound, (JP-A-4-261476); a cleaning liquid improved in antifoaming properties by containing a silicon antifoaming agent (JP-A-2000-328093); a maintenance liquid of pH 8 to 11 when a specific crosslinking ink is used (JP-A-2000-109733); a cleaning liquid comprising a surfactant (JP-A-11-263021, JP-A-11-263022); a cleaning liquid comprising a water-soluble salt of hydroxycarboxylic acid, limonene, and a surfactant (JP-A-2002-105500); and the like.

However, cleaning properties of the above cleaning liquids or maintenance liquids are insufficient in many cases due to the recent tendency of increase in colorant content in the ink mentioned above, and, as a result, there have been cases where serious reliability problems such as unstable discharge and nozzle clogging are caused. Particularly, in the pigment ink using a pigment as the colorant, the colorant (pigment) is present in the ink in the dispersed state, not in the dissolved state, and, therefore, when the pigment dispersion particles are aggregated by thickening or solidifying due to the ink drying, the cleaning liquids and the maintenance liquids are sometime insufficient for re-dispersion, thereby making the cleaning remarkably difficult.

Consequently, a maintenance liquid excellent in cleaning properties and usable for existing ink jet printers has been in demand.

SUMMARY

One of advantages according to some aspects of this invention is provision of a novel maintenance liquid for ink jet recording, which is excellent in cleaning properties when used for an ink jet printer using a pigment ink having a high colorant concentration, is free from adversely affecting on existing ink jet printers, and is excellent in antifoaming properties and antiseptic/antifungal effect.

Furthermore, other advantages and effects of some aspect of this invention will become apparent from the following description.

The present inventors have made eager investigation to examine the problem. As a result, it has been found that the foregoing advantages can be attained by the following constitution. The present invention is mainly directed to the following items:

1. A maintenance liquid for ink jet recording, comprising water, a resin solvent, and a moisturizing agent.

2. The maintenance liquid for ink jet recording according to the item 1, wherein the resin solvent is soluble in water, and the maintenance liquid for ink jet recording comprises: the resin solvent in an amount of from 0.1 to 10% by weight; and the moisturizing agent in an amount of from 1 to 50% by weight.

3. The maintenance liquid for ink jet recording according to the item 2, wherein the resin solvent includes at least one selected from the group consisting of alcohols, ethers, ketones, esters, nitrogen-containing compounds, and sulfur-containing compounds.

4. The maintenance liquid for ink jet recording according to the item 2, which further comprises a penetrating agent.

5. The maintenance liquid for ink jet recording according to the item 2, which further comprises at least one antiseptic/antifungal agent selected from the group consisting of isothiazolone compounds and oxazolidine compounds in an amount of from 50 ppm to 1% by weight.

6. The maintenance liquid for ink jet recording according to the item 2, which has a pH of from 6 to 11 at 25° C.

7. The maintenance liquid for ink jet recording according to the item 2, which has a surface tension of 40 mN/m or less at 25° C.

8. An ink jet printer having a pigment ink, the maintenance liquid for ink jet recording according to the item 2 being used for the ink jet printer.

9. The maintenance liquid for ink jet recording according to the item 1, wherein the resin solvent is insoluble or hardly soluble in water, and the maintenance liquid for ink jet recording further comprises a surfactant for solubilizing and/or emulsifying the resin solvent in water.

10. The maintenance liquid for ink jet recording according to the item 9, wherein the resin solvent includes at least one selected from the group consisting of alcohols, ethers, ketones, esters, nitrogen-containing compounds, and sulfur-containing compounds.

11. The maintenance liquid for ink jet recording according to the item 9, wherein the surfactant includes at least one selected from the group consisting of nonionic surfactants and anionic surfactants.

12. The maintenance liquid for ink jet recording according to the item 9, which comprises the resin solvent in an amount of from 0.1 to 5% by weight, and the moisturizing agent in an amount of from 1 to 50% by weight, based on a total amount of the maintenance liquid.

13. The maintenance liquid for ink jet recording according to the item 9, which further comprises a penetrating agent.

14. The maintenance liquid for ink jet recording according to the item 9, which further comprises at least one antiseptic/antifungal agent selected from the group consisting of isothiazolone compounds and oxazolidine compounds in an amount of from 50 ppm to 1% by weight.

15. The maintenance liquid for ink jet recording according to the item 9, which has a pH of from 6 to 11 at 25° C.

16. The maintenance liquid for ink jet recording according to the item 9, which has a surface tension of 40 mN/m or less at 25° C.

17. An ink jet printer having a pigment ink, the maintenance liquid for ink jet recording according to the item 9 being used for the ink jet printer.

By using the maintenance liquid of the above constitution, it is possible to provide the novel maintenance liquid for ink jet recording, which is excellent in cleaning properties when used for an ink jet printer using a pigment ink having a high colorant concentration, is free from adversely affecting on existing ink jet printers, and is excellent in antifoaming properties and an antiseptic/antifungal effect. As a result, it is provide an effect of suppressing serious reliability problems such as unstable discharge, nozzle clogging, and the like even when the ink jet printer is allowed to stand for a long period of time.

DESCRIPTION OF EXEMPLARY EMBODIMENTS

Hereinafter, this invention is described in detail based on preferred embodiments thereof The maintenance liquid for ink jet recording of this invention contains water, a resin solvent, and a moisturizing agent. The resin solvent can be classified into two categories depending on solubility, namely into water-soluble resin solvents and resin solvents insoluble or hardly soluble in water, and it is possible to use any of these resin solvents in accordance with usage and object. When the water-soluble resin solvent is used as the resin solvent, the resin solvent is preferably contained in an amount of from 0.1 to 10% by weight, and the moisturizing agent is preferably contained in an amount of from 1 to 50% by weight, based on a total amount of the maintenance liquid. Also, when the resin solvent that is insoluble or hardly soluble in water is used, it is necessary to use the resin solvent in combination with a surfactant for solubilizing and/or emulsifying the resin solvent in water. The resin solvent preferably includes at least one selected from the group consisting of alcohols, ethers, ketones, esters, nitrogen-containing compounds, and sulfur-containing compounds. The maintenance liquid containing such a resin solvent has good cleaning properties and hardly or never causes defects such as unstable discharge and nozzle clogging after cleaning or charging. Particularly, the maintenance liquid has excellent cleaning properties when defects such as thickening and solidification are caused by drying in a pigment ink of which a colorant is a pigment.

Reasons for the effective suppression and elimination of the above defects by the resin solvent have not been clarified, but, for example, they can be evaluated as follows. That is, the resin solvent contained in the maintenance liquid for ink jet recording is a good solubilizer and/or softener for a resin dispersant ordinarily used for the purpose of dispersing the pigment into the ink and excellent in effect of rapidly dissolving or dispersing solid contents (pigment, resin dispersant, and the like) into the maintenance liquid by rapidly permeating into a thickened or solidified substance and softening, dispersing, or dissolving the thickened or solidified substance which is generated by drying of the pigment ink. Also, since the resin solvents have good wettability to a material of an inner surface of an ink flow passage, such as SUS, generally used for the ink jet printers, it is possible to substitute the ink component adhered to the members effectively with the maintenance liquid. Further, by the appropriate content of the moisturizing agent, it is possible to suppress reactivity of the resin solvent with ink flow passage members (particularly plastic members) in the ink jet printer, and the members are not adversely affected even if condensation drying is caused by moisture evaporation in the maintenance liquid when the printer is at rest for a long period of time after the cleaning or charging. Among the above resin solvents, the water-soluble resin solvents function as a good solvent for a water-soluble dye, so that the water-soluble resin solvents are also excellent in function of easily re-dissolving a thickened or solidified substance caused by drying of a dye ink.

Hereinafter, constituents of the maintenance liquid for ink jet recording of this invention are described.

Resin Solvent

It is essential that the maintenance liquid for ink jet recording contains the resin solvent. The resin solvent is characterized by functioning as a good solubilizing agent particularly for the resin dispersant ordinarily contained in the pigment ink. An ordinary aqueous pigment ink contains a pigment serving as a colorant, a resin dispersant for dispersing the pigment into water, and water as main ingredients, and a water-soluble organic solvent and the like are added thereto as required. When the pigment ink is dried in an ink flow passage of a printer, the water, the water-soluble organic solvent and the like are gradually evaporated to ultimately become a thickened or solidified substance mainly containing the pigment and the resin dispersant, resulting in occurrence of defects such as clogging. The thickened or solidified substance is hardly dissolved or dispersed into water. The above-described conventional cleaning liquids and maintenance liquids have certain effect as compared to water, but most of the conventional cleaning liquids and maintenance liquids are insufficient in cleaning function and recovery function for overcoming the defects such as clogging. In contrast, since the maintenance liquid for ink jet recording of this invention is excellent in function of rapidly dissolving or dispersing the thickened or solidified substance in the maintenance liquid by the action of the resin solvent contained therein, the maintenance liquid for ink jet recording has high cleaning properties and recovery properties and, as a result, is excellent in effect of overcoming the defects such as clogging.

The resin solvent having the above effect is described below.

Specific examples of the water-soluble resin solvent are given below. In this invention, the water-soluble resin solvent means a resin solvent having solubility of 3% by weight or more in water at 25° C.

Examples of the alcohols include 1-butanol, isobutyl alcohol, tert-butyl alcohol, 2-pentanol, 3-pentanol, tert-pentyl alcohol, 3-methyl-2-butanol, neopentyl alcohol, allyl alcohol, propargyl alcohol, benzyl alcohol, cyclohexanol, 2-methylcyclohexanol, 1,3-butanediol, 2,3-butanediol, 2-methyl-2,4-pentanediol, 2-ethyl-1,3-hexanediol, 2-ethyl-2-(hydroxymethyl)-1,3-propanediol, 1,2,6-hexanetriol, furfuryl alcohol, tetrahydrofurfuryl alcohol, and diacetone alcohol.

Examples of the ethers include dioxane, trioxane, tetrahydrofuran, tetrahydropyrane, 1,2-dimethoxyethane, 1,2-diethoxyethane, diethylene glycol dimethyl ether, diethylene glycol diethyl ether, diethylene glycol dibutyl ether, methylal, and acetal.

Examples of the ketones include acetone, methyl ethyl ketone, 2-pentanone, 3-pentanone, acetonylacetone, and cyclohexanone.

Examples of the esters include methyl formate, ethyl formate, methyl acetate, ethyl acetate, 3-methoxybutyl acetate, methyl propionate, γ-butylolactone, diethyl oxalate, dimethyl maleate, monoacetine, diacetine, triacetine, ethylene carbonate, propylene carbonate, triethyl phosphate, acetonitrile, methyl lactate, ethyl lactate, butyl lactate, 2-methoxyethyl acetate, 2-ethoxyethyl acetate, diethylene glycol monoethyl ether acetate, methyl acetoacetate, ethyl acetoacetate, and hexamethylphosphoric triamide.

Examples of the nitrogen-containing compounds include pyridine, α-picoline, β-picoline, γ-picoline, ethylenediamine, propylenediamine, tetraethylenepentamine, formamide, N-methylformamide, N,N-dimethylformamide, N,N-diethylformamide, acetamide, N-methylacetamide, N,N-dimethylacetamide, N,N,N',N'-tetramethylurea, ε-caprolactam, morpholine, and N-methylmorpholine.

Examples of the sulfur-containing compounds include sulfolane.

Hereinafter, specific examples of the resin solvent insoluble or hardly soluble in water are described. In this invention, the resin solvent insoluble or hardly soluble in water means a resin solvent having solubility of less than 3% by weight in water at 25° C.

Examples of the alcohols include 2-methyl-1-butanol, 3-methyl-1-butanol, 1-hexanol, 2-methyl-1-pentanol, 4-methyl-2-pentanol, 2-ethyl-1-butanol, 1-heptanol, 2-heptanol, 3-heptanol, 1-octanol, 2-octanol, 2-ethyl-1-hexanol, 1-nonanol, 3,5,5-trimethyl-1-hexanol, 1-decanol, and 2-(benzyloxy)ethanol.

Examples of the ethers include dibutyl ether, dihexyl ether, propylene oxide, furan, and 2-methylfuran.

Examples of the ketones include 2-hexanone, 2-methyl-4-pentanone, 2-heptanone, 4-heptanone, 2,6-dimethyl-4-heptanone, mesityloxide, phorone, and isophorone.

Examples of the esters include n-propyl formate, n-butyl formate, isobutyl formate, n-amyl formate, n-propyl acetate, n-butyl acetate, isobutyl acetate, sec-butyl acetate, n-amyl acetate, isopentyl acetate, sec-hexyl acetate, 2-ethylbutyl acetate, 2-ethylhexyl acetate, cyclohexyl acetate, benzyl acetate, ethyl propionate, butyl propionate, isopentyl propionate, methyl butyrate, ethyl butyrate, butyl butyrate, isopentyl butyrate, isobutyl isobutyrate, ethyl isovalerate, isopentyl isovalerate, butyl stearate, pentyl stearate, methyl benzoate, ethyl benzoate, propyl benzoate, butyl benzoate, isopentyl benzoate, benzyl benzoate, ethyl abietiate, benzyl abietiate, bis(2-ethylhexyl)adipate, dibutyl tartrate, tributyl citrate, dibutyl sebacate, bis(2-ethylhexyl)sebacate, dimethyl phthalate, diethyl phthalate, dibutyl phthalate, bis(2-ethylhexyl) phthalate, dioctyl phthalate, diethyl carbonate, and 2-butoxyethyl acetate.

Examples of the nitrogen-containing compounds include 1-nitropropane and 2-nitropropane.

Examples of the sulfur-containing compounds include dimethyl sulfide, diethyl sulfide, and thiophene.

The above resin solvents may be used alone or in combination of two or more for the maintenance liquid for ink jet recording of this invention.

The resin solvent is preferably in an amount of from 0.1 to 10% by weight in the maintenance liquid for ink jet recording of this invention when the water-soluble resin solvent is used as the resin solvent. When the amount is less than 0.1% by weight, the above-described effects may not be obtained satisfactorily. When the amount is more than 10% by weight, cleaning properties is deteriorated by reduction in fluidity caused by increase in viscosity of the maintenance liquid, and reactivity with ink flow passage members of a printer is increased to adversely affect on the members when the maintenance liquid is charged for a long period of time.

When the resin solvent insoluble or hardly soluble in water is used as the resin solvent, the amount is preferably from 0.1 to 5% by weight. When the amount is less than 0.1% by weight, the above-described effects may not be obtained satisfactorily. When the amount is more than 5% by weight, cleaning properties are deteriorated by reduction in fluidity caused by increase in viscosity of the maintenance liquid, and reactivity with ink flow passage members of a printer is increased to adversely affect on the members when the maintenance liquid is charged for a long period of time.

Moisturizing Agent

It is essential that the maintenance liquid for ink jet recording of this invention contains the moisturizing agent. The moisturizing agent to be used in this invention has low volatility properties and high water retention ability and is selected from those highly compatible with the resin solvent. With such selection, it is possible to suppress drying of the maintenance liquid due to water evaporation, thereby preventing alternation of a composition of the maintenance liquid otherwise caused when the maintenance liquid is allowed to stand for a long time. Therefore, when an apparatus is at rest for a long period of time after being charged with the maintenance liquid, the effect of the maintenance liquid is sustained, and the reactivity of the resin solvent with the ink flow passage members in the printer is suppressed.

More specifically, usable as the moisturizing agent having the above characteristics are polyols such as glycerin, ethylene glycol, diethylene glycol, triethylene glycol, tetraethylene glycol, polyethylene glycol, propylene glycol, dipropylene glycol, polypropylene glycol, 1,3-propanediol, 1,4-butanediol, 1,5-pentanediol, and pentaerythritol; lactams such as 2-pyrrolidone and N-methyl-2-pyrrolidone; and the like.

Further, in order to support the abilities of the above materials, it is possible to use or add a water-soluble solid moisturizing agent. Specific examples of the water-soluble solid moisturizing agent include diols such as 1,6-hexanediol, 1,8-octanediol, 2,2-dimethyl-1,3-propanediol, 2,2-diethyl-1,3-propanediol; trimethylolethane, trimethylolpropane, etc.; urea, etc.; monosaccharides, disaccharides, oligosaccharides and polysaccharides such as glucose, mannose, fructose, ribose, xylose, arabinose, galactose, aldonic acid, glucitol (sorbit), maltose, cellobiose, lactose, sucrose, trehalose, and maltotriose, and derivatives of the saccharides. Examples of the derivatives of the saccharides include reduced sugars, oxidized sugars, amino acids, and thiosugars of the above sugars; and the like. As the derivatives of the sugars, sugar alcohols are particularly preferred, and specific examples include maltitol, sorbit, and the like.

An additive amount of the moisturizing agents when used alone or in combination is preferably from 1 to 50% by weight, based on a total amount of the maintenance liquid. When the additive amount is less than 1% by weight, the above-described effect may not be exhibited satisfactorily. When the additive amount is more than 50% by weight, the cleaning properties may be deteriorated by deterioration in fluidity caused by increase in viscosity.

Surfactant

When the resin solvent that is insoluble or hardly soluble in water is selected from the above-described resin solvents, it is essential that the maintenance liquid contains the surfactant for solubilizing and/or emulsifying the resin solvent in water. The maintenance liquid for ink jet recording has a constitution wherein the water is a main ingredient in view of safety, versatility, user friendliness, and the like as described later in this specification. When the resin solvent that is insoluble or hardly soluble in water is used in this invention, it is necessary to use a substance for solubilizing and/or emulsifying the resin solvent in water in order to contain the resin solvent in an amount capable of achieving the effect.

The surfactant to be used for the maintenance liquid of this invention is not particularly limited, so long as the surfactant stably solubilizes and/or emulsifies the resin solvent in water and is dissolved and/or dispersed in water, and a nonionic surfactant or an anionic surfactant is preferably used.

Examples of the nonionic surfactant include fluorine surfactants such as sorbitan fatty acid ester, glycerin fatty acid ester, decaglin fatty acid ester, polyglycerin fatty acid ester, propylene glycol/pentaerythritol fatty acid ester, polyoxyethylene sorbitan fatty acid ester, polyoxyethylene sorbit fatty acid ester, polyoxyethylene glycerin fatty acid ester, polyethylene glycol fatty acid ester, polyoxyethylene alkyl ether, polyoxyethylene polyoxypropylene alkyl ether, polyoxyethylene/polyoxypropylene/block polymer, polyoxyethylene alkylphenyl ether, polyoxyethylene caster oil, polyoxyethylene lanolin/lanolin alcohol, polyoxyethylene alkylamine/fatty acid amide, a polyoxyethylene alkylphenylformaldehyde condensate, and polyoxyethylene perfluoroalkyl.

Examples of the anionic surfactant include alkyl sulfates, alkyl diallyl ether dicarboxylates, alkyl diallyl ether sulfonates, polyoxyethylene alkyl sulfates, N-acylamino acid and salts thereof, N-acylmethyltaurine salts, dialkylsulfosuccinates, disodium sulfosuccinic acid monoester, N-alkylsulfosuccinic acid monoamide, polyoxyethylene alkyl ether acetates, alkylsulfocarboxylates, α-olefinsulfonates, alkylphosphates, polyoxyethylene alkyl ether phosphates, and the like.

The above-described surfactants is preferably used as an active ingredient in an amount of from 0.01 to 5% by weight, based on a total amount of the maintenance liquid of this invention. Within this range, it is possible to maintain appropriate viscosity of the maintenance liquid as well as to stably solubilize and/or emulsify the required amount of the resin solvent that is insoluble or hardly soluble in water into the maintenance liquid. When the amount is less than 0.01% by weight, it is difficult to solubilize and/or emulsify the required amount of the resin solvent that is insoluble or hardly soluble in water, in the maintenance liquid, so that the function of the maintenance liquid is not exhibited in some cases. Also, when the resin solvent is added to the required amount, a separated portion of the resin solvent sometimes reacts with the ink flow passage members (particularly plastic members) in the ink jet printer. When the amount is more than 5% by weight, the cleaning properties may be deteriorated by reduction in fluidity caused by increase in viscosity of the maintenance liquid.

The above-described surfactants may be used alone or in combination of two or more.

Water

The water is a principal medium of the maintenance liquid for ink jet recording of this invention, and, for the purpose of reducing ionic impurities as much as possible, the water is preferably purified water such as ion exchange water, ultrafiltration water, reverse osmosis water, and distilled water or ultrapure water.

Water that is sterilized by irradiation with UV ray or by addition of hydrogen peroxide is suitably used since such water prevents generation of molds and bacteria when the maintenance liquid is stored for a long period of time.

The maintenance liquid for ink jet recording of this invention contains the resin solvent, the moisturizing agent, and the water described above as the essential ingredients, and, when the resin solvent that is insoluble or hardly soluble in water is used, the surfactant for solubilizing and/or emulsifying the resin solvent is contained as the essential ingredient. With such constitution, the maintenance liquid is excellent in cleaning properties when used in an ink jet printer using a pigment ink having a high colorant concentration, is usable in existing ink jet printers since the maintenance liquid does not adversely affect on the ink flow passage members of the printers when allowed to stand for a long period of time, and is excellent in antifoaming properties and antiseptic/antifungal effect. However, it is possible to improve the characteristics of the maintenance liquid by adding the following ingredients thereto. The ingredients are described below.

Penetrating Agent

In accordance with another aspect of the maintenance liquid for ink jet recording according to this invention, the maintenance liquid may contain a penetrating agent. The maintenance liquid is further improved in cleaning properties when the penetrating agent is contained therein. Reasons for the improvement in cleaning properties have not been clarified, but, for example, they can be estimated as follows. That is, each of the penetrating agents listed below has a hydrophilic portion and a hydrophobic portion in a molecule and acts for reducing a surface tension of the maintenance liquid. Therefore, the penetrating agent improves wettability to the ink flow passage members in the printer and has excellent action of efficiently substituting the ink ingredient present in the ink flow passage with the maintenance liquid. Also, due to excellent wettability and permeability to the thickened or solidified substance generated by drying of the ink, the penetration agent has action of causing rapid permeation of the maintenance liquid into the thickened/solidified substance. Therefore, the effect of the resin solvent contained in the maintenance liquid of effectively and efficiently permeating into the thickened/solidified substance and dispersing and dissolving the solidified substance and the like into the maintenance liquid is further enhanced.

Examples of the penetrating agent having such effect include glycol monoether derivatives which are polyvalent alcohols and 1,2-alkyldiols.

The glycol monoether derivatives of the polyvalent alcohol are preferably derivatives of polyvalent alcohol wherein alkyl has 3 or more carbon atoms. Specific examples of such glycol monoether derivatives include ethylene glycol monobutyl ether, diethylene glycol mono-n-propyl ether, ethylene glycol mono-iso-propyl ether, diethylene glycol mono-iso-propyl ether, ethylene glycol mono-n-butyl ether, ethylene glycol mono-tert-butyl ether, diethylene glycol mono-n-butyl ether, triethylene glycol mono-n-butyl ether, diethylene glycol mono-tert-butyl ether, 1-methyl-1-methoxybutanol, propylene glycol mono-tert-butyl ether, propylene glycol mono-n-propyl ether, propylene glycol mono-iso-propyl ether, propylene glycol mono-n-butyl ether, dipropylene glycol mono-n-butyl ether, dipropylene glycol mono-n-propyl ether, dipropylene glycol mono-iso-propyl ether, and the like. An additive amount of the polyvalent alcohol glycol monoether is preferably in the range of 15% by weight or less, based on a total amount of the maintenance liquid.

As the 1,2-alkyldiol, 1,2-alkyldiol having 4 to 8 carbon atoms such as butanediol, pentanediol, hexanediol, heptanediol, octanediol is preferred. Among the above, 1,2-hexanediol, 1,2-heptanediol, and 1,2-octanediol each having 6 to 8 carbon atoms is particularly preferred due to its strong effects of improving the wettability of the maintenance liquid to ink flow passage members and of improving the permeation of the maintenance liquid to the thickened/solidified substance caused by the ink drying. An additive amount of the 1,2-alkyldiol is preferably 5% by weight or less to the total amount of the maintenance liquid.

Other examples of the penetrating agent include acetylene glycol surfactants and acetylene alcohol surfactants. The acetylene glycol surfactants and the acetylene alcohol surfactants have lower bubbling property and more excellent in antifoaming properties than other surfactants. Therefore, the acetylene glycol surfactants and the acetylene alcohol surfactants eliminate defects such as dot omission otherwise caused by bubbles in the maintenance liquid and enable efficient cleaning.

Specific examples of the acetylene glycol surfactants and the acetylene alcohol surfactants include Surfynol 104, 104E, 104H, 104A, 104BC, 104DPM, 104PA, 104PG-50, 104S, 420, 440, 465, 485, SE, SE-F, 504, 61-DF37, CT111, CT121, CT131, CT136, TG, and GA (trade names; products of Air Products and Chemicals, Inc.); Olfin B, Y, P, A, STG, SPC, E1004, E1010, PD-001, PD-002W, PD-003, PD-004, EXP. 4001, EXP. 4036, EXP. 4051, AF-103, AF-104, AK-02, SK-14, AE-3 (trade names; products of Nissin Chemical Industry, Co., Ltd.), Acetylenol E00, E00P, E40, E100 (trade names; product of Kawaken Fine Chemicals, Co., Ltd.), and the like. An additive amount of the acetylene glycol surfactants and the acetylene alcohol surfactants may be decided appropriately and a preferred additive amount is 10% by weight or less, based on a total amount of the maintenance liquid.

The above-described penetrating agents may be used alone or in combination of two or more.

Antiseptic/Antifungal Agent

The maintenance liquid for ink jet recording of this invention may further contain an antiseptic/antifungal agent according to another embodiment. The antiseptic/antifungal agent to be used in this invention is preferably selected from the group consisting of isothiazolone compounds and oxazolidine compounds. When bacteria, mold and the like are generated in the maintenance liquid, the bacteria, the mold, and the like may clog up the head nozzle or the ink flow passage in the ink jet printer as contaminants to exert adverse affects on the ink discharge. However, by using the antiseptic/antifungal agent, it is possible to more effectively prevent the generation of bacteria, mold, and the like even when the maintenance liquid is allowed to stand for a long period of time.

The antiseptic/antifungal agent is preferably contained in an amount of from 50 ppm to 1% by weight, more preferably from 100 ppm to 0.5% by weight, in the maintenance liquid for ink jet recording of this invention. When the amount is less than 50 ppm, the above-described effect may not be obtained sufficiently. When the amount is more than 1% by weight, the antiseptic/antifungal agent may be precipitated when its solubility is limited, thereby deteriorating discharge stability.

Specific examples of the antiseptic/antifungal gent to be contained in the maintenance liquid for ink jet recording of this invention include Proxel XL2 and Proxel GXL (trade names; products of Avecia KK); Denicide CSA and NS-500W (trade names; product of Nagase ChemteX Corporation); and the like. The antiseptic/antifungal agents may be used alone or in combination of two or more.

Physical Properties and the Like of Maintenance Liquid

A pH value of the maintenance liquid for ink jet recording of this invention at 25° C. is preferably from 6 to 11, more preferably from 7 to 10. When the pH value is less than 6, the cleaning properties may not be obtained satisfactorily when the maintenance liquid is used in an ink jet printer using an ink containing an anionic compound as a colorant. When the pH value is more than 11, the reactivity of the maintenance liquid with the ink flow passage members may be increased to cause alternation of the members, generation of contaminants, unstable discharge, and the like. A water-soluble basic substance may be used for adjusting the pH value of the maintenance liquid to the above range.

Specific examples of the basic substance include sodium hydroxide, potassium hydroxide, lithium hydroxide, and inorganic alkalis such as ammonium.

Other examples of the basic substance include carbonates such as potassium (hydrogen)carbonate, sodium (hydrogen) carbonate, lithium (hydrogen)carbonate; phosphates; salts of alkylcarboxylic acid such as acetate and propionate; organic acids of hydroxy acid salts such as lactate, glycolate, and glycerate, particularly, alkali metal salts of alkylcarboxylic acids, such as sodium acetate, potassium acetate, sodium propionate, and potassium propionate; and the like.

Also, organic buffer agents such as tris(hydroxymethyl) aminomethane, tris-hydrochloride, tris-maleic acid, and bis (2-hydroxyethyl)iminotris(hydroxymethyl)methane are exemplified.

Also, various amine compounds are exemplified. Examples of preferred amine compounds include water-soluble volatile amine, alkanolamine, and the like. Specific examples of the amine compounds include volatile amine substituted with an alkyl group (e.g. methylamine, dimethylamine, trimethylamine, ethylamine, diethylamine, triethylamine, propylamine, isopropylamine, dipropylamine, diisopropylamine, butylamine, isobutylamine, sec-butylamine, tert-butylamine, dibutylamine, diisobutylamine, pentylamine, etc.); alkanolamine substituted with an alkanol group (e.g. 2-aminoethanol, 2-(dimethylamino)ethanol, 2-(diethylamino)ethanol, diethanolamine, N-butylethanolamine, triethanolamine, isopropanolamine, etc.); alkylalkanolamine substituted with an alkyl group and an alkanol group; and the like.

The maintenance liquid for ink jet recording of this invention preferably has a surface tension of 40 mN/m or less, more preferably 35 mN/m or less, at 25° C. The wettability to surfaces of the ink flow passage members generally used for the ink jet printer is improved by the surface tension within the above range, thereby making it possible to efficiently substitute the ink component with the maintenance liquid.

In order to adjust the surface tension to the above range, the above-described penetrating agents and surfactants may be used as required. As the surfactants, in addition to the acetylene glycol/acetylene alcohol surfactants described above as the penetrating agents, it is possible to select from ordinary anionic surfactants, cationic surfactants, amphoteric surfactants, and nonionic surfactants. However, from the stand point of obtaining the maintenance liquid reduced in foaming and bubbling, the nonionic surfactants are particularly preferred. Specific examples of the nonionic surfactants include ether surfactants such as polyoxyethylene nonylphenyl ether, polyoxyethylene octylphenyl ether, polyoxyethylene dodecylphenyl ether, polyoxyethylene alkylallyl ether, polyoxyethylene oleyl ether, polyoxyethylene lauryl ether, polyoxyethylene alkyl ether, and polyoxyalkylene alkyl ether; ester surfactants such as polyoxyethylene oleic acid, polyoxyethylene oleic acid ester, polyoxyethylene distearic acid ester, sorbitan laurate, sorbitan monostearate, sorbitan monooleate, sorbitan sesquioleate, polyoxyethylene monooleate, and polyoxyethylene stearate; silicon surfactants such as dimethylpolysiloxane; fluorine-containing surfactants such as fluorine alkyl ester and perfluoroalkyl carboxylate; and the like.

Preferred Usage to which the Maintenance Liquid of this Invention is Applied

The maintenance liquid for ink jet recording of this invention is preferably used for ink jet printers using a pigment ink. Since the maintenance liquid of this invention has excellent cleaning properties as described above, the maintenance liquid is suitably used for the ink jet printers using the pigment ink that is increasingly used in recent years. The pigment ink contains a pigment as a colorant, and usable pigments include carbon black; pigment yellow, pigment red, pigment violet, pigment blue, and pigment black, which are disclosed in the color index; and other pigments such as phthalocyanine, azo, anthraquinone, azomethine, and condensed ring pigments. Also, organic pigments such as yellow No. 4, No. 5, No. 205, and No. 401; orange No. 228 and No. 405; blue No. 1 and No. 404 as well as inorganic pigments such as titanium oxide, zinc oxide, zirconium oxide, iron oxide, cobalt blue, iron blue, and chrome oxide are usable as the pigments. When the pigment is used as the colorant, it is preferable to use a dispersant together with the pigment or to use a surface treated pigment as the pigment from the stand point of dispersion stability in the ink.

Since the ink is discharged from the nozzle having a microdiameter of about 20 to 50 μm in the ink jet recording method, thickening and deposition of the ink are liable to be caused by volatilization of low boiling point solvent, separation of colorant, aggregation, and the like in the vicinity of the nozzle front end, sometimes leading to defects such as disturbed print and nozzle clogging. These problems are liable to be caused when the apparatus is at rest for a long period of time. This invention has been accomplished for solving such problems. The maintenance liquid of this invention is suitably used for both of methods solving the problems (1) a method of cleaning an ink flow passage when the defects are caused and (2) a method of substituting the ink with the maintenance liquid in advance of a rest when the apparatus is scheduled to be rest for a long time. Particularly, in a pigment ink using a colorant wherein pigment particles are dispersed with a resin dispersant, the maintenance liquid of this invention has a great effect on the case of (1). Even when the pigment ink using the colorant wherein pigment particles are dispersed with the resin dispersant is thickened/solidified by drying in an ink flow passage of an ink jet printer, the thickened/solidified substance is sufficiently dispersed and removed by the resin solvent contained in the maintenance liquid of this invention.

EXAMPLES

The present invention is now illustrated in greater detail with reference to Examples and Comparative Examples, but it should be understood that the present invention is not to be construed as being limited thereto.

Adjustment of Maintenance Liquid

The maintenance liquids of Examples 1 to 26 and Comparative Examples 1 to 4 were prepared by using compositions shown in Table 1 to 4. Each of the maintenance liquids was stirred sufficiently and then filtered under pressure at a pressure of 2 kg/cm$^2$ using a membrane filter having 1 μm-pores. The maintenance liquids were used for the following evaluations.

TABLE 1

| Maintenance Liquid Components | | Example | | | | | | | |
|---|---|---|---|---|---|---|---|---|---|
| (the numbers in the table are based on % by weight) | | 1 | 2 | 3 | 4 | 5 | 6 | 7 | 8 |
| Resin Solvent | Diacetone alcohol | 5.0 | — | — | — | — | — | — | 1.0 |
| | Tetrahydrofuran | — | 5.0 | — | — | — | — | 5.0 | — |
| | Acetonylacetone | — | — | 5.0 | — | — | — | — | 1.0 |
| | Ethyl acetate | — | — | — | 2.0 | — | — | — | — |
| | N,N-dimethylformamide | — | — | — | — | 0.1 | — | 5.0 | 1.0 |
| | Sulfolane | — | — | — | — | — | 1.0 | — | — |
| | 2-Heptanol | — | — | — | — | — | — | — | — |
| | Propylene oxide | — | — | — | — | — | — | — | — |
| | 4-heptanone | — | — | — | — | — | — | — | — |
| | 2-ethylhexyl acetate | — | — | — | — | — | — | — | — |
| | 1-nitropropane | — | — | — | — | — | — | — | — |
| | Diethyl sulfide | — | — | — | — | — | — | — | — |
| Surfactant | Polyoxyethylene oleyl ether | — | — | — | — | — | — | — | — |
| | Polyoxyethylene sorbitan mono laurate | — | — | — | — | — | — | — | — |
| | Polyoxyethylene hardened caster oil | — | — | — | — | — | — | — | — |

TABLE 1-continued

| Maintenance Liquid Components | | Example | | | | | | | |
|---|---|---|---|---|---|---|---|---|---|
| (the numbers in the table are based on % by weight) | | 1 | 2 | 3 | 4 | 5 | 6 | 7 | 8 |
| | Polyoxyethylene nonylphenyl ether | — | — | — | — | — | — | — | — |
| | Sodium dialkylsulfosuccinate | — | — | — | — | — | — | — | — |
| | Sodium alkyldiphenyl ether disulfonate | — | — | — | — | — | — | — | — |
| Moisturizing Agent | Glycerin | 30.0 | — | 10.0 | — | — | 10.0 | 20.0 | 10.0 |
| | Triethylene glycol | — | 20.0 | 5.0 | 10.0 | — | — | 25.0 | 2.0 |
| | 2-pyrrolidone | — | — | 5.0 | 3.0 | — | 1.0 | 2.5 | 1.0 |
| | Trimethylolpropane | — | 5.0 | 5.0 | — | — | — | 2.0 | — |
| | Maltitol | — | — | — | 0.5 | 1.0 | 0.5 | 0.5 | 2.0 |
| Penetrating Agent | Triethylene glycol monobutyl ether | — | — | 3.0 | — | 2.0 | 1.0 | 3.0 | 1.0 |
| | 1,2-hexanediol | — | — | — | — | 2.0 | 1.0 | 2.0 | — |
| | Surfynol 104 | — | — | — | 0.1 | 0.2 | 0.1 | 0.2 | 0.2 |
| | Olfin E1010 | — | — | — | 1.0 | — | 1.0 | — | — |
| Others | Proxel XL2 | — | — | — | — | — | — | 0.3 | 0.3 |
| | Potassium hydroxide | — | — | — | — | — | — | — | 0.1 |
| | Triethanolamine | — | — | — | — | — | — | — | 0.9 |
| | Sodium carbonate | — | — | — | — | — | — | — | — |
| | Sodium hydrocarbonate | — | — | — | — | — | — | — | — |
| | FS antifoam 92 | — | — | — | — | — | — | — | — |
| Water | Ion exchange water | 65.0 | 70.0 | 67.0 | 83.4 | 94.7 | 84.4 | 34.5 | 79.5 |
| hysical Properties | pH (at 25° C.) | 7.0 | 7.1 | 7.4 | 7.0 | 7.4 | 7.5 | 8.8 | 9.8 |
| | Surface tension (mN/m, at 25° C.) | 38 | 34 | 39 | 36 | 33 | 31 | 30 | 31 |

TABLE 2

| Maintenance Liquid Components | | Example | | | | | | | |
|---|---|---|---|---|---|---|---|---|---|
| (the numbers in the table are based on % by weight) | | 9 | 10 | 11 | 12 | 13 | 14 | 15 | 16 |
| Resin Solvent | Diacetone alcohol | — | 1.0 | 0.05 | 11.0 | — | — | — | — |
| | Tetrahydrofuran | 2.0 | 1.0 | — | — | — | — | — | — |
| | Acetonylacetone | — | 1.0 | — | — | — | — | — | — |
| | Ethyl acetate | 2.0 | 0.5 | — | — | — | — | — | — |
| | N,N-Dimethylformamide | — | 0.5 | — | — | — | — | — | — |
| | Sulfolane | 2.0 | 0.5 | — | — | — | — | — | — |
| | 2-Heptanol | — | — | — | — | 1.0 | — | — | — |
| | Propylene oxide | — | — | — | — | — | 1.0 | — | — |
| | 4-Heptanone | — | — | — | — | — | — | 1.0 | — |
| | 2-Ethylhexyl acetate | — | — | — | — | — | — | — | 2.0 |
| | 1-Nitropropane | — | — | — | — | — | — | — | — |
| | Diethyl sulfide | — | — | — | — | — | — | — | — |
| Surfactant | Polyoxyethylene oleyl ether | — | — | — | — | 1.0 | — | — | — |
| | Polyoxyethylene sorbitan mono laurate | — | — | — | — | — | 1.0 | — | — |
| | Polyoxyethylene hardened caster oil | — | — | — | — | — | — | 1.0 | — |
| | Polyoxyethylene nonylphenyl ether | — | — | — | — | — | — | — | 1.0 |
| | Sodium dialkylsulfosuccinate | — | — | — | — | — | — | — | 0.5 |
| | Sodium alkyldiphenyl ether disulfonate | — | — | — | — | — | — | — | — |
| Moisturizing Agent | Glycerin | 10.0 | 15.0 | 30.0 | 30.0 | 30.0 | — | 10.0 | — |
| | Triethylene glycol | 10.0 | 5.0 | — | — | — | 20.0 | 5.0 | 10.0 |
| | 2-Pyrrolidone | 3.0 | — | — | — | — | — | 5.0 | 3.0 |
| | Trimethylol propane | 2.0 | 2.5 | — | — | — | 5.0 | 5.0 | — |
| | Maltitol | 5.0 | — | — | — | — | — | — | 0.5 |
| Penetrating Agent | Triethylene glycol monobutyl ether | 2.5 | 1.0 | — | — | — | — | 3.0 | — |
| | 1,2-Hexanediol | 2.0 | 1.0 | — | — | — | — | — | — |
| | Surfynol 104 | 0.2 | — | — | — | — | — | — | 0.1 |
| | Olfin E1010 | 2.0 | 1.0 | — | — | — | — | — | 1.0 |
| Others | Proxel XL2 | 0.3 | 0.3 | — | — | — | — | — | — |
| | Potassium hydroxide | — | — | — | — | — | — | — | — |
| | Triethanolamine | 1.0 | 1.0 | — | — | — | — | — | — |
| | Sodium carbonate | — | — | — | — | — | — | — | — |
| | Sodium hydrocarbonate | — | — | — | — | — | — | — | — |
| | FS antifoam 92 | — | — | — | — | — | — | — | — |
| Water | Ion exchange water | 56.0 | 68.7 | 69.5 | 59.0 | 68.0 | 73.0 | 70.0 | 81.9 |
| Physical Properties | pH (at 25° C.) | 9.5 | 9.0 | 7.0 | 6.8 | 7.0 | 7.1 | 7.4 | 8.0 |
| | Surface tension (mN/m, at 25° C.) | 29 | 30 | 55 | 35 | 33 | 34 | 32 | 30 |

TABLE 3

| Maintenance Liquid Components | | Example | | | | | | | |
|---|---|---|---|---|---|---|---|---|---|
| (the numbers in the table are based on % by weight) | | 17 | 18 | 19 | 20 | 21 | 22 | 23 | 24 |
| Resin Solvent | Diacetone alcohol | — | — | — | — | — | — | — | — |
| | Tetrahydrofuran | — | — | — | — | — | — | — | — |
| | Acetonylacetone | — | — | — | — | — | — | — | — |
| | Ethyl acetate | — | — | — | — | — | — | — | — |
| | N,N-Dimethylformamide | — | — | — | — | — | — | — | — |
| | Sulfolane | — | — | — | — | — | — | — | — |
| | 2-Heptanol | — | — | — | 1.0 | — | 1.0 | 0.05 | 6.0 |
| | Propylene oxide | — | — | 0.3 | — | 2.0 | 1.0 | — | — |
| | 4-Heptanone | — | — | — | 1.0 | — | 1.0 | — | — |
| | 2-Ethylhexyl acetate | — | — | 0.3 | — | 2.0 | 0.5 | — | — |
| | 1-Nitropropane | 0.1 | — | — | — | — | 0.1 | — | — |
| | Diethyl sulfide | — | 1.0 | — | 1.0 | 1.0 | 0.5 | — | — |
| Surfactant | Polyoxyethylene oleyl ether | — | 0.5 | — | 1.0 | 0.5 | 1.0 | 1.0 | 1.0 |
| | Polyoxyethylene sorbitan mono laurate | — | — | 0.5 | — | 1.0 | 1.0 | — | — |
| | Polyoxyethylene hardened caster oil | — | — | — | 1.0 | 1.0 | 1.0 | — | — |
| | Polyoxyethylene nonylphenyl ether | — | — | — | 0.5 | 0.5 | 0.5 | — | — |
| | Sodium dialkylsulfosuccinate | — | 0.5 | — | — | 1.0 | 0.5 | — | — |
| | Sodium alkyldiphenyl ether disulfonate | 0.01 | — | 0.5 | 1.0 | 1.0 | 0.5 | — | — |
| Moisturizing Agent | Glycerin | — | 10.0 | 20.0 | 10.0 | 20.0 | 15.0 | 30.0 | 30.0 |
| | Triethylene glycol | — | — | 25.0 | 2.0 | 15.0 | 5.0 | — | — |
| | 2-pyrrolidone | — | 1.0 | 2.5 | 1.0 | 5.0 | — | — | — |
| | Trimethylol propane | — | — | 2.0 | — | 5.0 | 2.5 | — | — |
| | Maltitol | 1.0 | 0.5 | 0.5 | 2.0 | 5.0 | — | — | — |
| Penetrating Agent | Triethylene glycol monobutyl ether | — | 1.0 | 3.0 | 1.0 | 2.5 | 1.0 | — | — |
| | 1,2-Hexanediol | — | 1.0 | 2.0 | — | 2.0 | 1.0 | — | — |
| | Surfynol 104 | — | 0.1 | 0.2 | 0.2 | 0.2 | — | — | — |
| | Olfin E1010 | — | 1.0 | — | — | 2.0 | 1.0 | — | — |
| Others | Proxel XL2 | — | — | 0.3 | 0.3 | 0.3 | 0.3 | — | — |
| | Potassium hydroxide | — | — | — | 0.1 | — | — | — | — |
| | Triethanolamine | — | — | — | 0.9 | 1.0 | 1.0 | — | — |
| | Sodium carbonate | — | — | — | — | — | — | — | — |
| | Sodium hydrocarbonate | — | — | — | — | — | — | — | — |
| | FS antifoam 92 | — | — | — | — | — | — | — | — |
| Water | Ion exchange water | 98.89 | 83.4 | 42.9 | 76.0 | 32.0 | 64.6 | 68.95 | 63.0 |
| Physical Properties | pH (at 25° C.) | 7.4 | 7.5 | 8.8 | 9.8 | 9.5 | 9.0 | 7.0 | 6.8 |
| | Surface tension (mN/m, at 25° C.) | 39 | 31 | 30 | 31 | 29 | 30 | 33 | 30 |

TABLE 4

| Maintenance Liquid Components | | Example | | Comparative Example | | | |
|---|---|---|---|---|---|---|---|
| (the numbers in the table are based on % by weight) | | 25 | 26 | 1 | 2 | 3 | 4 |
| Resin Solvent | Diacetone alcohol | — | — | — | — | — | — |
| | Tetrahydrofuran | — | — | — | — | — | — |
| | Acetonylacetone | — | — | — | — | — | — |
| | Ethyl acetate | — | — | — | — | — | — |
| | N,N-Dimethylformamide | — | — | — | — | — | — |
| | Sulfolane | — | — | — | — | — | — |
| | 2-Heptanol | 1.0 | 1.0 | — | — | — | — |
| | Propylene oxide | — | — | — | — | — | — |
| | 4-Heptanone | — | — | — | — | — | — |
| | 2-Ethylhexyl acetate | — | — | — | — | — | — |
| | 1-Nitropropane | — | — | — | — | — | — |
| | Diethyl sulfide | — | — | — | — | — | — |
| Surfactant | Polyoxyethylene oleyl ether | 1.0 | 1.0 | — | — | — | — |
| | Polyoxyethylene sorbitan mono laurate | — | — | — | — | — | — |
| | Polyoxyethylene hardened caster oil | — | — | — | — | — | — |
| | Polyoxyethylene nonylphenyl ether | — | — | — | — | 1.0 | — |
| | Sodium dialkylsulfosuccinate | — | — | — | — | — | — |
| | Sodium alkyldiphenyl ether disulfonate | — | — | — | — | — | — |
| Moisturizing Agent | Glycerin | 0.5 | 55.0 | — | 30.0 | — | — |
| | Triethylene glycol | — | — | — | — | — | — |
| | 2-Pyrrolidone | — | — | — | — | — | — |
| | Trimethylol propane | — | — | — | — | — | — |
| | Maltitol | — | — | — | — | — | — |
| Penetrating Agent | Triethylene glycol monobutyl ether | — | — | — | — | — | — |
| | 1,2-Hexanediol | — | — | — | — | — | — |
| | Surfynol 104 | — | — | — | — | — | — |
| | Olfin E1010 | — | — | — | — | — | — |

TABLE 4-continued

| Maintenance Liquid Components | | Example | | Comparative Example | | | |
|---|---|---|---|---|---|---|---|
| (the numbers in the table are based on % by weight) | | 25 | 26 | 1 | 2 | 3 | 4 |
| Others | Proxel XL2 | — | — | — | 0.3 | — | — |
| | Potassium hydroxide | — | — | — | — | — | — |
| | Triethanolamine | — | — | — | — | — | 0.05 |
| | Sodium carbonate | — | — | — | — | 1.0 | — |
| | Sodium hydrocarbonate | — | — | — | — | 0.38 | — |
| | FS antifoam 92 | — | — | — | — | — | 0.1 |
| Water | Ion exchange water | 93.5 | 39.0 | 100.0 | 69.7 | 97.62 | 99.85 |
| Physical Properties | pH (at 25° C.) | 7.0 | 6.7 | 7.0 | 7.5 | 10.2 | 6.7 |
| | Surface tension (mN/m, at 25° C.) | 33 | 33 | 71 | 56 | 28 | 30 |

Evaluation 1

Evaluation of Cleaning Properties

An on-demand ink jet printer PX-V500 (trade name; product of Seiko-Epson Corporation) charged with inks wherein pigments are used, and then ink flow passages and front end interiors were cleaned by using 5 cc of each of the maintenance liquids of Examples 1 to 26 and Comparative Examples 1 to 4. The ink flow passages and the front end interiors were observed visually, and then judgments were made depending on an amount of residual inks and based on the following criteria.

Judgment A: the inks were almost perfectly removed, and cleaning properties are excellent.

Judgment B: almost all the inks were removed, and cleaning properties are good.

Judgment C: a large amount of residual inks were observed, and cleaning properties are poor.

Evaluation 2

Evaluation of Retention

After charging the ink jet printer PX-V500 with the inks, the ink flow passages and the front end interiors were cleaned by using 5 cc of each of the maintenance liquids of Examples 1 to 26 and Comparative Examples 1 to 4. In a state where the maintenance liquid was charged, the printer was allowed to stand for a week in an environment of 60° C. The vicinity of the nozzles of the head after the standing was observed with a microscope, and then judgments were made depending on an amount of residual inks and based on the following criteria.

Judgment A: very few contaminants adhered to the nozzle vicinity.

Judgment B: a few contaminants adhered to the nozzle vicinity, but the contaminants did not clog up the nozzles.

Judgment C: contaminants adhered to the nozzle vicinity and clogged up the nozzles.

Evaluation 3

Evaluation of Discharge Stability

After charging the ink jet printer PX-V500 with the inks, the ink flow passages and the front end interiors were cleaned by using 5 cc of each of the maintenance liquids of Examples 1 to 26 and Comparative Examples 1 to 4. In a state where the maintenance liquid was charged, the printer was allowed to stand for a week in an environment of 60° C. Thereafter, the printer was returned to an ordinary temperature environment and then charged with the ink again to perform fill image printings successively. Judgments were made depending on discharge stability such as a lacked dot and a skewed dot and based on the following criteria.

Judgment A: unstable discharge such as a curved flight and non-discharge did not occur immediately after the ink charging.

Judgment B: discharge stability was achieved by performing 2 or less cleaning operations as the printer after the ink charging.

Judgment C: 3 or more cleaning operations as the printer were required after the ink charging for achieving the discharge stability.

Evaluation 4

Evaluation of Recovery Properties

After charging the ink jet printer PX-V500 with the inks, the printer was allowed to stand for a week in an environment of 60° C. After returning the printer after the standing to an ordinary temperature environment, the ink flow passages and the front end interiors were cleaned by using 10 cc of each of the maintenance liquids of Examples 1 to 26 and Comparative Examples 1 to 4. Thereafter, the printer was charged with the inks again to perform fill image printings successively. Judgments were made depending on discharge stability such as a lacked dot and a skewed dot and based on the following criteria.

Judgment A: unstable discharge such as a curved flight and non-discharge did not occur immediately after the ink charging.

Judgment B: discharge stability was achieved by performing 2 or less cleaning operations as the printer after the ink charging.

Judgment C: 3 or more cleaning operations as the printer were required after the ink charging for achieving the discharge stability, or the discharge stability was not recovered.

Judgment D: dried inks inside the ink flow passages and the head were not cleaned by the maintenance liquid, and it was impossible to charge the printer with the inks.

Results of the evaluations are summarized in Tables 5 and 6.

TABLE 5

| Evaluation Items | Example 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| Evaluation 1: Cleaning Properties | A | A | A | A | B | A | A | A | A | A | B | A | B | B | A |
| Evaluation 2: Retention Properties | A | B | A | A | A | A | A | A | A | A | A | C | A | A | A |
| Evaluation 3: Discharge Stability | A | A | A | A | A | A | A | A | A | A | B | C | A | A | A |
| Evaluation 4: Recovery Properties | B | A | A | B | B | A | A | A | A | A | C | A | A | A | A |

TABLE 6

| Evaluation Items | Example 16 | 17 | 18 | 19 | 20 | 21 | 22 | 23 | 24 | 25 | 26 | Comparative Example 1 | 2 | 3 | 4 |
|---|---|---|---|---|---|---|---|---|---|---|---|---|---|---|---|
| Evaluation 1: Cleaning Properties | A | B | A | B | A | A | A | B | A | A | C | C | B | B | B |
| Evaluation 2: Retention Properties | A | A | A | A | A | A | A | A | C | B | A | C | B | C | C |
| Evaluation 3: Discharge Stability | A | B | A | A | A | A | A | B | B | B | B | C | C | C | C |
| Evaluation 4: Recovery Properties | A | B | A | A | A | A | A | C | A | C | B | D | D | C | D |

As is apparent from Tables 5 and 6, the maintenance liquids each containing the water, the resin solvent and the moisturizing agent exhibited excellent cleaning properties. Particularly, the maintenance liquids were excellent in cleaning properties and recovery properties when the inks were dried to become thickened/solidified substances inside the ink flow passages and the heads of the printer. The maintenance liquids of Examples 3 to 10, 15, 16, and 18 to 22 each of which further contains the penetrating agent and/or other additives (antiseptic/antifungal agent, etc.), wherein the amounts of the resin solvent and the moisturizing agent according to this invention are in the preferable range and the physical properties are in the preferable range, exhibited better cleaning properties and recovery properties. In contrast, the maintenance liquid of Comparative Examples 1 to 4 each of which did not contain the resin solvent were inferior in cleaning properties, retention properties, and recovery properties, resulting in deteriorated discharge stability after the ink charging.

As described above, with the use of the maintenance liquid having the constitution of this invention, it is possible to provide a novel maintenance liquid for ink jet recording which is excellent in cleaning properties when used in an ink jet printer using a pigment ink having a high colorant concentration; usable in existing ink jet printers without adversely affecting on members of the printer; and excellent in antifoaming properties and antiseptic/antifungal effect. As a result, the maintenance liquid has an effect of preventing serious reliability problems such as unstable discharge and nozzle clogging even when the ink jet printer is allowed to stand for a long period of time.

While the present invention has been described in detail and with reference to specific embodiments hereof, it will be apparent to one skilled in the art that various changes and modifications can be made therein without departing from the spirit and scope thereof.

What is claimed is:

1. A maintenance liquid for ink jet recording, comprising water, a resin solvent that is soluble in water, and a moisturizing agent, wherein the resin solvent is at least one compound selected from the group consisting of alcohols, ethers, ketones, esters, nitrogen-containing compounds and sulfur-containing compounds, said resin solvent being present in the maintenance liquid in an amount of from 0.1 to 10% by weight, and wherein said moisturizing agent is selected from the group consisting of polyols and lactams, said moisturizing agent being present in the maintenance liquid in an amount effective to suppress drying of the maintenance liquid due to water evaporation and thereby to inhibit alteration of the maintenance liquid upon standing that might otherwise occur without the moisturizing agent, said amount of the moisturizing agent being from 1 to 50% by weight.

2. The maintenance liquid according to claim 1, which further comprises a penetrating agent.

3. The maintenance liquid according to claim 1, which further comprises at least one antiseptic/antifungal agent selected from the group consisting of isothiazolone compounds and oxazolidine compounds in an amount of from 50 ppm to 1% by weight.

4. The maintenance liquid according to claim 1, which has a pH of from 6 to 11 at 25° C.

5. The maintenance liquid according to claim 1, which has a surface tension of 40 mN/m or less at 25° C.

6. The maintenance liquid according to claim 1, which consists essentially of water, the resin solvent and the moisturizing agent.

7. The maintenance liquid according to claim 1, wherein the resin solvent is selected from the group consisting of diacetone alcohol, tetrahydrofuran, acetonylacetone, ethyl acetate, N,N-dimethylformamide, sulfolane, 2-heptanol, propylene oxide, 4-heptanone, 2-ethylhexyl acetate, 1-nitropropane and diethyl sulfide.

8. The maintenance liquid according to claim 7, wherein the moisturizing agent is selected from the group consisting of glycerin, triethylene glycol, 2-pyrrolidone, trimthylol propane and maltitol.

9. A method comprising (i) providing an ink jet printer with an ink flow passage comprising a thickened or solidified substance containing a pigment and a resin dispersant, and (ii) cleaning the passage with the maintenance liquid according to claim 1, wherein the resin solvent in the maintenance liquid is a solubilizing agent for the resin dispersant.

10. A kit comprising (i) an inkjet printer; (ii) an aqueous pigment ink comprising a pigment serving as colorant, a resin dispersant for dispersing the pigment in water, and water;

and (iii) the maintenance liquid according to claim 1, wherein the resin solvent in the maintenance liquid is a solubilizing agent for the resin dispersant in the pigment ink.

11. A maintenance liquid for ink jet recording, comprising water, a resin solvent that is insoluble or hardly soluble in water, a moisturizing agent, and a surfactant, wherein the resin solvent is at least one compound selected from the group consisting of alcohols, ethers, ketones, esters, nitrogen-containing compounds and sulfur-containing compounds, said resin solvent being present in the maintenance liquid in an amount of from 0.1 to 5% by weight, wherein said moisturizing agent is selected from the group consisting of polyols and lactams, said moisturizing agent being present in the maintenance liquid in an amount effective to suppress drying of the maintenance liquid due to water evaporation and thereby to inhibit alteration of the maintenance liquid upon standing that might otherwise occur without the moisturizing agent, said amount of the moisturizing agent being from 1 to 50% by weight and wherein the surfactant is present in an amount effective for solubilizing and/or emulsifying the resin solvent in water.

12. The maintenance liquid according to claim 11, wherein the surfactant is at least one selected from the group consisting of nonionic surfactants and anionic surfactants.

13. The maintenance liquid according to claim 11, which further comprises a penetrating agent.

14. The maintenance liquid according to claim 11, which further comprises at least one antiseptic/antifungal agent selected from the group consisting of isothiazolone compounds and oxazolidine compounds in an amount of from 50 ppm to 1% by weight.

15. The maintenance liquid according to claim 11, which has a pH of from 6 to 11 at 25° C.

16. The maintenance liquid according to claim 11, which has a surface tension of 40 mN/m or less at 25° C.

17. The maintenance liquid according to claim 11, wherein the resin solvent is selected from the group consisting of diacetone alcohol, tetrahydrofuran, acetonylacetone, ethyl acetate, N,N-dimethylformamide, sulfolane, 2-heptanol, propylene oxide, 4-heptanone, 2-ethylhexyl acetate, 1-nitropropane and diethyl sulfide.

18. The maintenance liquid according to claim 17, wherein the moisturizing agent is selected from the group consisting of glycerin, triethylene glycol, 2-pyrrolidone, trimthylol propane and maltitol.

19. A method comprising (i) providing an ink jet printer with an ink flow passage comprising a thickened or solidified substance containing a pigment and a resin dispersant, and (ii) cleaning the passage with the maintenance liquid according to claim 11, wherein the resin solvent in the maintenance liquid is a solubilizing agent for the resin dispersant.

20. A kit comprising (i) an inkjet printer; (ii) an aqueous pigment ink comprising a pigment serving as colorant, a resin dispersant for dispersing the pigment in water, and water;

and (iii) the maintenance liquid according to claim 11, wherein the resin solvent in the maintenance liquid is a solubilizing agent for the resin dispersant in the pigment ink.

* * * * *